US010273078B2

(12) United States Patent
Zanchetta et al.

(10) Patent No.: US 10,273,078 B2
(45) Date of Patent: Apr. 30, 2019

(54) TRANSPORTABLE TECHNICAL CONTAINER FOR CHEMICAL LIQUIDS

(71) Applicant: LAINOX ALI SPA, Vittorio Veneto (TV) (IT)

(72) Inventors: Moreno Zanchetta, Vittorio Veneto (IT); Pierluigi Amico, Fiesso d'Artico (IT)

(73) Assignee: ALI GROUP SRL, Cernusco Sul Naviglio (MI) (IT)

( * ) Notice: Subject to any disclaimer, the term of this patent is extended or adjusted under 35 U.S.C. 154(b) by 107 days.

(21) Appl. No.: 15/262,265

(22) Filed: Sep. 12, 2016

(65) Prior Publication Data

US 2017/0113866 A1 Apr. 27, 2017

(30) Foreign Application Priority Data

Oct. 22, 2015 (IT) ..... 202015000064529

(51) Int. Cl.

| | |
|---|---|
| ***B65D 23/10*** | (2006.01) |
| ***B65D 85/84*** | (2006.01) |
| ***B65D 25/28*** | (2006.01) |
| ***B65D 1/20*** | (2006.01) |
| ***B65D 21/02*** | (2006.01) |

(Continued)

(52) U.S. Cl.

CPC ..... *B65D 85/84* (2013.01); *B65D 1/20* (2013.01); *B65D 21/0202* (2013.01); *B65D 21/0209* (2013.01); *B65D 25/2882* (2013.01); *B65D 25/2894* (2013.01); *B65D 41/04* (2013.01); *B65D 43/0225* (2013.01); *F24C 14/005* (2013.01)

(58) Field of Classification Search

CPC ..... B65D 85/84; B65D 1/20; B65D 21/0202; B65D 21/0209; B65D 25/2882; B65D 25/2894; B65D 25/38; B65D 25/40; B65D 41/04; B65D 43/0225; F24C 14/005

USPC ..... 206/503; 220/661, 771, 571, 565, 601

See application file for complete search history.

(56) References Cited

U.S. PATENT DOCUMENTS 4,632,268 A * 12/1986 Melzi ..... B65D 81/36 206/508
4,969,571 A * 11/1990 Bartz ..... B65D 1/20 215/382

(Continued)

FOREIGN PATENT DOCUMENTS

| | | | |
|---|---|---|---|
| CH | 695453 | A5 | 5/2006 |
| JP | H0440252 | A | 2/1992 |
| KR | 20130027863 | A | 3/2013 |

*Primary Examiner* — Fenn C Mathew
*Assistant Examiner* — Elizabeth J Volz
(74) *Attorney, Agent, or Firm* — Egbert Law Offices, PLLC

(57) ABSTRACT

Transportable technical container for chemical liquids provided with a container body at least provided with a base wall, with an opposite upper wall and with perimeter walls, said container body realizing a containment chamber, wherein the technical container is provided with a grip handle and with a threaded cylindrical mouth closable by a threaded closing cap, wherein the height of each perimeter wall is in any case lower than the width and length dimensions both of the base wall and of the upper wall in such a way that the technical container assumes a substantially flattened shape so as to be able to be positioned in the space present below a professional oven of the known type.

9 Claims, 12 Drawing Sheets

(51) Int. Cl.

| | |
|---|---|
| ***B65D 43/02*** | (2006.01) |
| ***B65D 41/04*** | (2006.01) |
| *F24C 14/00* | (2006.01) |

(56) References Cited

U.S. PATENT DOCUMENTS

| | | | | |
|---|---|---|---|---|
| D344,740 | S * | 3/1994 | Poirier | D15/150 |
| D520,367 | S * | 5/2006 | Morris | D9/527 |
| 8,678,188 | B2 * | 3/2014 | Larsen | B65D 21/0231 206/503 |
| 2015/0225124 | A1 * | 8/2015 | Persson | B65D 25/2885 222/475 |

* cited by examiner

TRANSPORTABLE TECHNICAL CONTAINER FOR CHEMICAL LIQUIDS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a transportable technical container for chemical liquids particularly for containing detergent liquids used in the cleaning of professional ovens intended for the food service industry.

The invention finds particular although not exclusive application in the sector of the industry of production and marketing of tanks and containers, in particular jerry cans, intended for containing chemical liquids, in particular corrosive chemical liquids, and especially liquid detergents for cleaning professional ovens included in the automatic devices for washing and cleaning the latter, the invention finding wide application in the industry of production and marketing of containers and jerry cans for containing liquids and in general in the industry of production of objects of plastic material.

2. Description of Related Art Including Information Disclosed Under 37 CFR 1.97 and 37 CFR 1.98

Widely known are the containers for liquids of the type provided with a closable mouth, which traditionally consist of a container structured in such a way as to create a closed containment chamber having sizes and shapes which may vary depending on the intended purpose, wherein said chamber is provided with a mouth closable by means of tight sealing means. Said containers can be both of the type not suitable to be transported easily due to their dimensions or due to the fact that they are prearranged for the anchorage to a fixed structure and, as far as the present solution is concerned, they can be of the type suitable to be transported manually. Among the containers which can be carried manually due to their compatible sizes and shape and because they are provided with a handle, which, due to such characteristics are commonly known by the term jerry cans, one can distinguish in first approximation those for containing non-dangerous liquids and those which, on the other hand, are made for the purpose of being able to safely contain liquids classified as dangerous, for example because they are corrosive, also enabling their storage and transport. Furthermore, the characteristics of the substance, which is intended to be transported, influence, by directly determining them, the construction characteristics of the jerry cans themselves, which have to be structured in such a way as to comply with specific resistance parameters and also to suit further technical characteristics, also involving the construction materials usable in their manufacturing. At present, in order to make the jerry cans which are intended for transport compliant with the characteristics of the transported liquids, especially if the latter are classified as dangerous substances, it is provided that their construction must comply with a series of regulations aimed at imposing, for each class of dangerous substances, at least some minimum safety standards. The guarantee that the container for containing and transporting dangerous substances complies with the technical specifications, which are required for a given class of substances by the current construction standards or by the regulations in force, is given by the need to obtain type approval. As far as the object of the present invention is concerned, the transportable containers in question are intended for containing liquid detergents for cleaning professional ovens, which usually and currently require the use of particularly aggressive substances in terms of corrosion degree, having to be suitable to remove the residues of cooking and the grease which accumulates on the walls of the cooking chamber of the oven. The substances currently used in the formulation of industrial liquid detergents for cleaning professional ovens usually include sodium hydroxide or potassium hydroxide, that is to say, extremely corrosive substances whose transport and storage require particular precautions and containers intended for this purpose. In the current state of the art, plastic materials with suitable resistance characteristics are preferably employed to make the containers for liquids, which are used for the purpose of containing said liquid detergents. In the case of professional equipment for cooking food, which is equipped with washing systems of the automatic type, it is usually provided that the supply of the detergent liquid of said automatic washing system is carried out by providing at least one hydraulic pump, particularly of the self-priming type, intended to draw the detergent liquid from a suitable tank that can be included in the professional oven, said container having to be periodically charged, as an alternative said tank being of the external type, separate from the oven, and on which tank one has to position the respective terminal pipe of the pump of the washing device of the oven, wherein the terminal part of said pipe is to be positioned through the cap of the container.

PRIOR ART

At present there exist many containers, also of the ferry can type, for dangerous liquids and in particular, as far as the object of the present invention is concerned, containers for containing detergent liquids intended to be used in the automatic washing systems of professional equipment for cooking food and especially in professional ovens, wherein said containers are mainly made in the form of jerry cans of plastic material being structured in such a way as to comply with the current type-approval criteria required. Furthermore, the transportable containers shaped as jerry cans and which are to be used as an external tank of the liquid detergent integrating the automatic washing systems of the equipment for cooking food, are of the vertical development type, whereas, as to the containers constituting the tanks which form part of the washing systems of the equipment, they, although being of different shapes to meet the construction requirements of the positioning compartment on which they are to be arranged, are in any case positioned permanently, being non-removable.

Also the known prior art, as in the currently available patent literature, discloses some solutions of containers for detergent liquids intended to feed the automatic washing systems which are particularly provided with professional ovens.

Among the solutions found, as a non-exhaustive example we will mention the following documents:

D1: CH695453A5 (Bagom)

D2: JPH0440252 (Toukou)

D3: KR20130027863 (Rinnai)

D1 synthetically describes a solution of a container with a double coating, a first coating of which is of hard plastic material while the second coating is of elastically deformable plastic material, the first coating of hard plastic constituting the external surface of the container while the second coating, which coats the first one, has a greater thickness with respect to the coating of hard plastic and can be made of a two-component epoxy resin, and it is provided that the walls of hard plastic are made of furnace-treated epoxy resin.

D2 synthetically describes a solution of a jerry can, with which cleaning equipment is provided, and a washing means intended to enable cleaning inside said tank, there being provided some nozzles, which are intended to convey a pressurized liquid which is addressed by means of the nozzles according to the solution both in a vertical direction and in a horizontal direction.

D3 synthetically describes a solution of a tank for washing water of a convection steam oven provided with a level device to detect the too-full condition in such a way as to keep the level of the washing liquid constant in order to maintain the oven cleaning operations always at the same quality standard in such a way as to optimize the mixing of the washing water, the detergent and the rinse aid.

Considering the known prior art as in D1 to D3 and the specific domain expertise acquired, it can be inferred that solutions of tanks are known, with which oven washing systems are equipped, which are of plastic material and which are intended for containing detergent liquids, some components of which consist of substances of the corrosive type, being provided with at least one grip handle for manual transport and with at least one threaded cylindrical mouth tightly closable by a threaded cap, on which threaded cylindrical mouth the terminal of the priming pipe of the oven washing systems can be positioned.

Drawbacks

All the known solutions of technical containers for chemical liquids, and in particular for containing detergent liquids for washing systems for professional ovens as in the known prior art, have, although to a different extent, some defects and/or limits.

A first distinctive limit of all the solutions of containers for washing liquids as in the known prior art, in the applicant's opinion, was observed in the ascertained impossibility for the current solutions of containers to act as replaceable capsules with a consequent increase in the times necessary to restore the washing systems in the case in which it is necessary to replace the detergent liquid.

A second distinctive limit of all the solutions of containers for washing liquids as in the known prior art, in the applicant's opinion, was observed in the detected circumstance that the current solutions, in the case in which they are a permanent feature of the washing device, needing to be filled periodically, do not allow to exclude the risk, inherent in the filling phases, of any accidental leakage of corrosive liquid, while in the case in which are of the conventional jerry can type, being intended to be positioned vertically, they are not suitable to be positioned below the oven or horizontally in a compartment of the latter.

Another distinctive limit of all the solutions of containers for washing liquids as in the known prior art, in the applicant's opinion, consists of the detected circumstance that they do not provide the possibility to be placed horizontally below the oven at the same time integrating the possibility to be manually transportable, furthermore having observed that the existing solutions do not allow to be positioned flat ensuring that the liquid flows in the suction region.

An additional distinctive limit of all the solutions of containers for washing liquids as in the known prior art, in the applicant's opinion, consists of the detected circumstance that they are not suitable to be easily and firmly stacked.

Therefore, there is the need for the companies of the sector to find some optimal solutions for obtaining the following pre-set aims.

BRIEF SUMMARY OF THE INVENTION

These and other aims are achieved by the present invention according to the characteristics as in the appended claims solving the above-mentioned problems by means of a transportable technical container (1) for chemical liquids provided with a container body (2) at least provided with a base wall (21), with an opposite upper wall (22) and with perimeter walls (23, 24, 25, 26), said container body (2) realizing a containment chamber (3), wherein the technical container (1) is provided with a grip handle (4) and with a threaded cylindrical mouth closable by means of a threaded closing cap (5) wherein the height of each perimeter wall (23, 24, 25, 26) is in any case lower than the width and length dimensions both of the base wall (21) and of the upper wall (22) in such a way that the technical container (1) assumes a substantially flattened shape so as to be able to be positioned in the space present below a professional oven (100) of the known type.

Aims

By the considerable creative contribution the effect of which constitutes an immediate technical progress some aims and advantages are achieved.

A first advantageous aim of the present invention consists in providing a transportable technical container for chemical liquids whose innovative realization provides the possibility that it can act as a replaceable capsule with a consequent reduction in the times necessary to restore the washing systems in the case in which it is necessary to replace the detergent liquid, at the same time providing the possibility, considering that it is easy to be transported, to enable in any case an easy supply of detergent liquids available only locally.

A second advantageous aim of the present invention consists in providing a transportable technical container for chemical liquids whose innovative realization provides the possibility that it can allow to avoid the need to carry out periodic fillings of the container for the supply of detergent liquid, thus eliminating the risk of accidental leaks of corrosive liquid inside the oven or in proximity to the latter, also providing the possibility to position said container below the oven in such a way that it does not hinder the movements of the staff in proximity to the oven.

A third advantageous aim of the present invention consists in providing a transportable technical container for chemical liquids whose innovative realization allows it to be able to be placed horizontally below the oven, at the same time integrating the possibility to be manually transportable, it being able to be positioned flat ensuring the constant flow of the liquid in the suction region.

Another advantageous aim of the present invention consists in providing a transportable technical container for chemical liquids whose innovative realization allows to stack several technical containers on top of one another in an easy and stable way.

A further advantageous aim of the present invention consists in providing a transportable technical container for chemical liquids whose innovative realization enables an improved positioning of the container also in the case in which the oven is equipped with guides so as to allow the container to be kept hanging and so as to allow the container to be inserted or extracted slidingly.

These and other advantages will appear from the following detailed description of some preferred embodiments whose details of execution are not to be considered limitative but only illustrative.

BRIEF DESCRIPTION OF THE SEVERAL VIEWS OF THE DRAWINGS

FIG. 7 shows a view of the technical container according to the present invention with replaceable capsule function before the positioning below the oven.

DETAILED DESCRIPTION OF THE INVENTION

Figure 1:
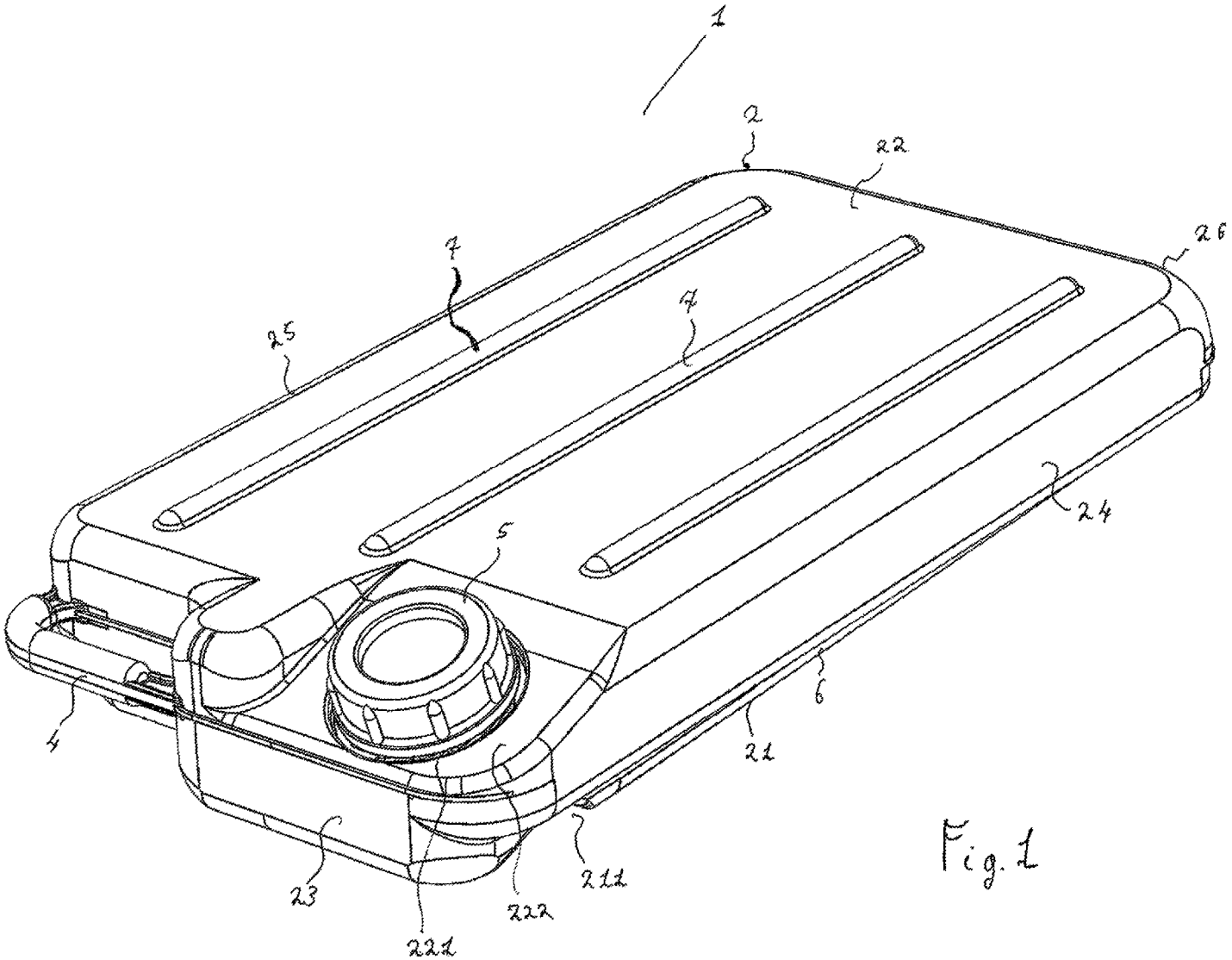
FIG. 1 shows an axonometric three-quarter view from above of the technical container according to the present invention.

With reference to the representations as in FIGS. 1 to 12 as well, a technical container is described (1) of the transportable type for chemical liquids particularly for containing detergent liquids used for cleaning ovens particularly intended for the foodservice industry, said technical container (1) is preferably made of plastic material and is intended to be used to contain chemical liquids and in particular detergent liquids and/or rinse aids or other liquids usable in the automatic washing systems of professional ovens, the material of construction also possibly being other than plastic material provided that it complies with the intended purposes of the present solution, which require said technical container (1) to be in any case suitable for containing chemical liquids of the corrosive type, said material of construction of the technical container (1) also having to comply at least with the required resistance characteristics for obtaining the type approval of the analogous containers intended for containing and transporting corrosive chemical liquids. In the embodiment example, which is described and which has to be considered as a basic solution, said technical container (1) is nearly parallelepiped shaped in such a way as to be preferably compliant with what is particularly represented in FIGS. 1 to 5, and is structured in such a way as to comprise a container body (2) which realizes a containment chamber (3) whose internal volume is determined in relation to the expected contingent requirements and which is usually between 0.5 liters and 10 liters, said capacity, however, being also able to be smaller or greater than what has been indicated to suit specific needs of destination and use.

Figure 2:
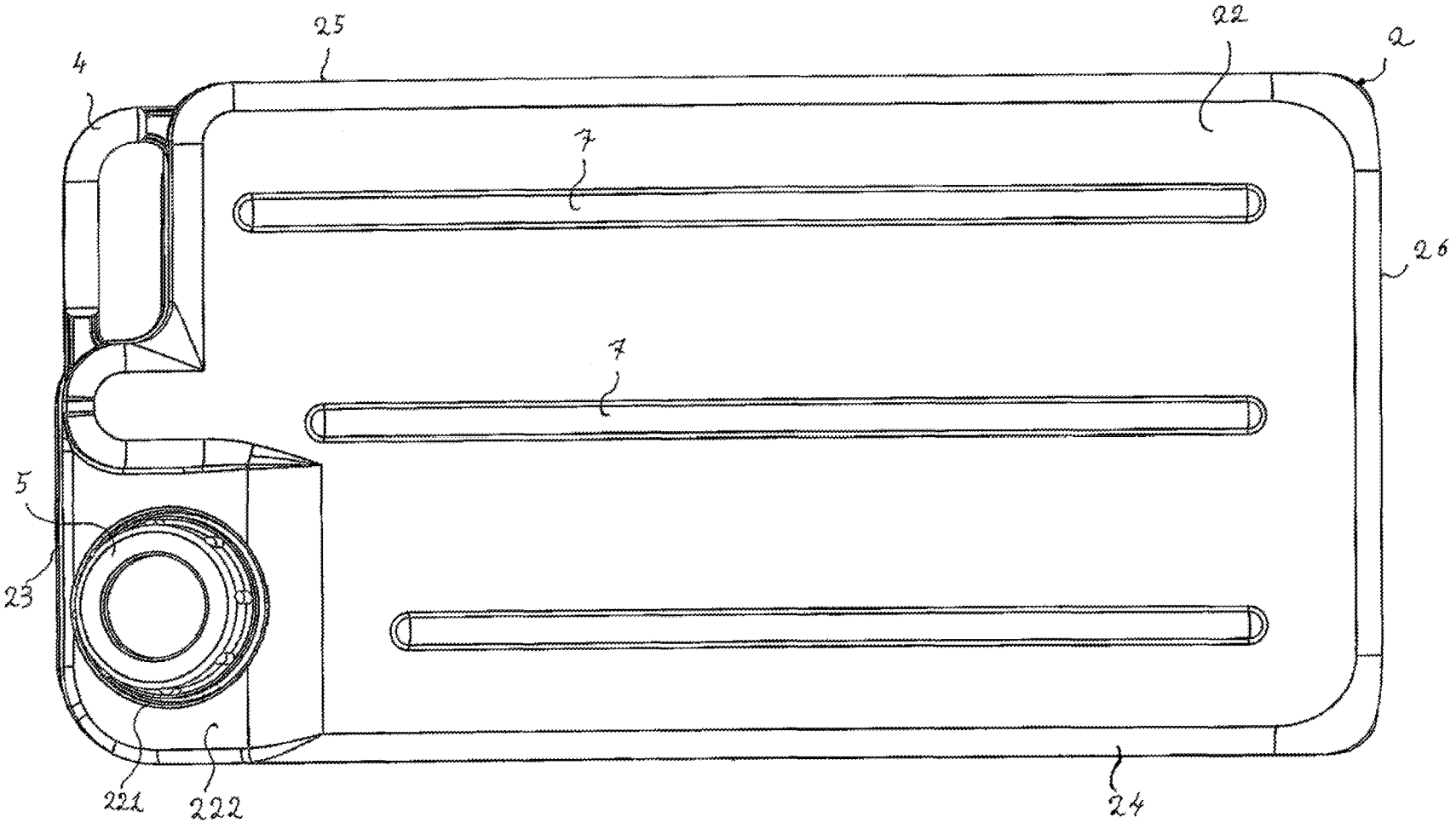
FIG. 2 shows a plan orthogonal projection view from above of the technical container according to the present invention.

In more detail as to the described embodiment example, as in FIGS. 1 to 5, said container body (2) is made in such a way as to comprise at least one base wall (21), an opposite upper wall (22) and some perimeter walls (23, 24, 25, 26) which in the described embodiment as particularly in FIGS. 1 and 2, consist of a front perimeter wall (23), of a right side perimeter wall (24), of a left side perimeter wall (25) and of a bottom perimeter wall (26) opposite to the front perimeter wall (23), wherein said perimeter walls (23, 24, 25, 26), enclosing the perimeter of the container body (2), connect the base wall (21) to the upper wall (22), wherein it is provided that the height of each perimeter wall (23, 24, 25, 26), which is given by the distance between the base wall (21) and the upper wall (22), is in any case lower than the width and length dimensions both of the base wall (21) and of the upper wall (22) in such a way that the technical container (1) assumes a substantially flattened shape so as to be able to be positioned in the space present below a professional oven (100) as is particularly shown in FIGS. 8 to 12, the distance between the base wall (21) and the upper wall (22) being remarkably limited, wherein the base wall (21) of the container body (2) acts as a ground support surface when the technical container (1) is to be put in an operating condition for the feeding of the automatic washing system of the oven (100).

Figure 3:
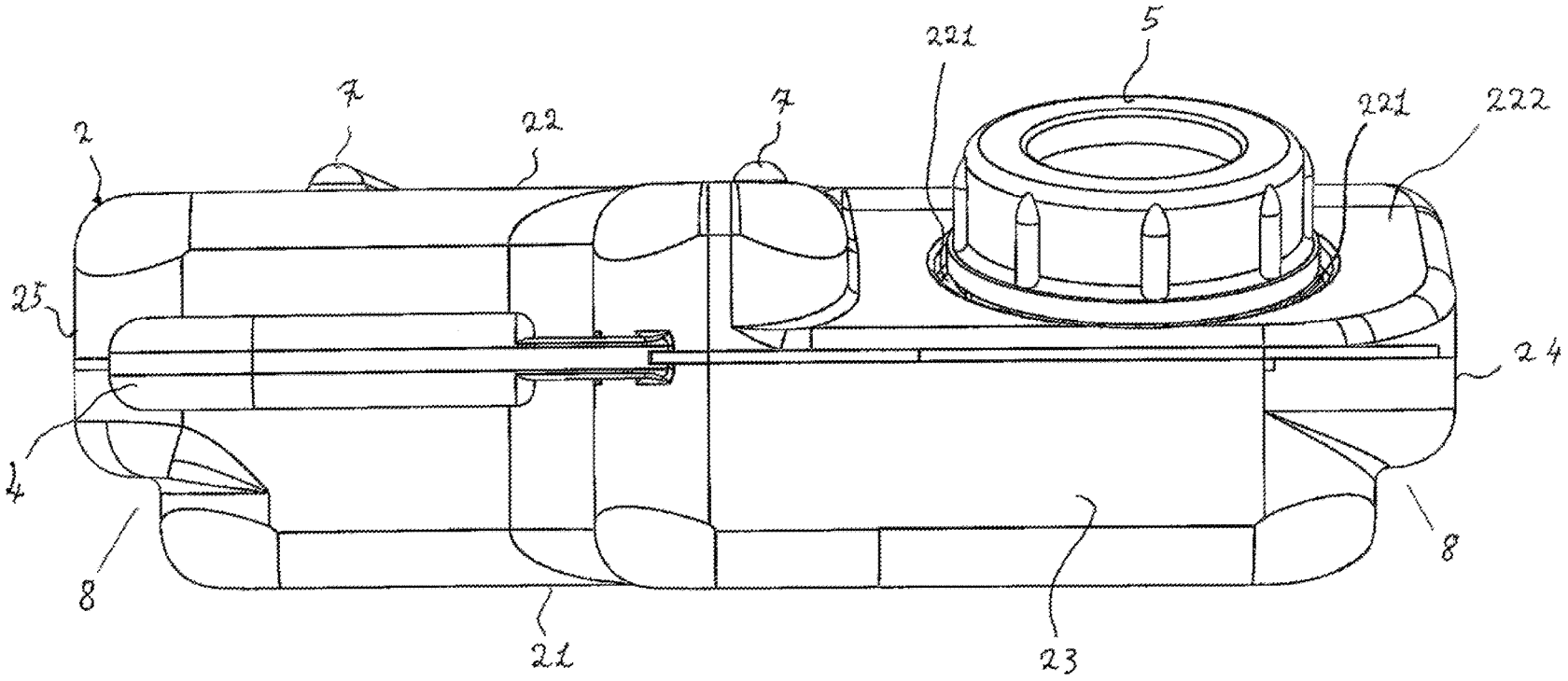
FIG. 3 shows a front orthogonal projection view of the technical container according to the present invention.
Figure 4:
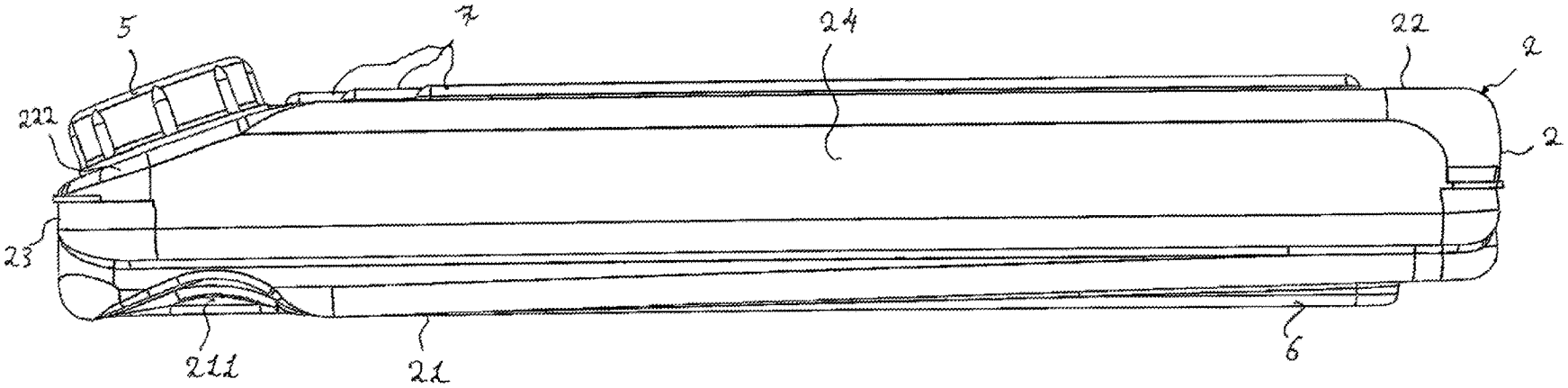
FIG. 4 shows a side orthogonal projection view of the technical container according to the present invention.

Furthermore, in order to be able to advantageously make the technical container (1) of the present invention handy, the container is provided with at least one grip handle (4) which is intended to enable its transport, said grip handle (4), in the described embodiment example and preferably, being placed in correspondence of the front part of the perimeter wall (23), being preferably made in such a way as to not protrude with respect to the maximum length and width of the container body (2) in such a way that the grip handle (4) in the described embodiment example as in particular in FIGS. 1 to 3 ideally completes the perimeter of the shape of the technical container (1).

In more detail as to the described embodiment example, the technical container (1) according to the present invention in correspondence of the upper wall (22) is provided with a threaded cylindrical mouth, of the known type and not shown, which is protruding with respect to a suitable recessed seat (221) placed on a recess (222) with which the upper wall (22) of the container body (2) is provided near a zone close to the front perimeter wall (23). Even in more detail, the threaded cylindrical mouth with which the container body (2) of the technical container (1) of the present invention is provided is made in such a way as to be suitably protruding with respect to the provided recess (222), said threaded cylindrical mouth preferably being, with respect to the horizontal plane, inclined forward in the direction of the front perimeter wall (23) although not extending beyond the vertical plane of the corresponding portion of the front perimeter wall (23). The threaded cylindrical mouth, in a known way similarly to what is provided for analogous containers of liquids, is tightly closable by means of a threaded closing cap (5) of the known type, the latter being of the type intended to be used on containers for corrosive liquids.

Figure 5:
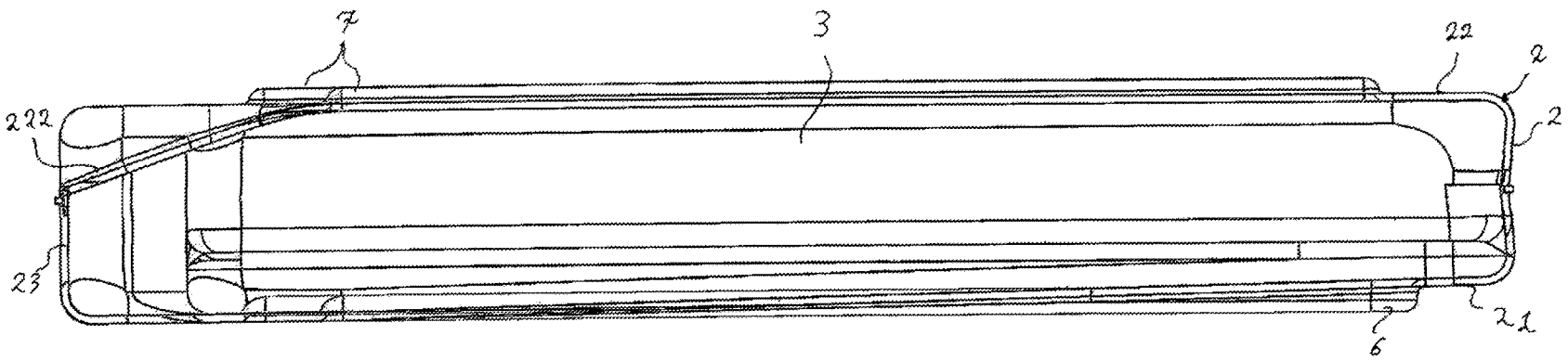
FIG. 5 shows a longitudinal section view of the technical container according to the present invention.
Figure 6:
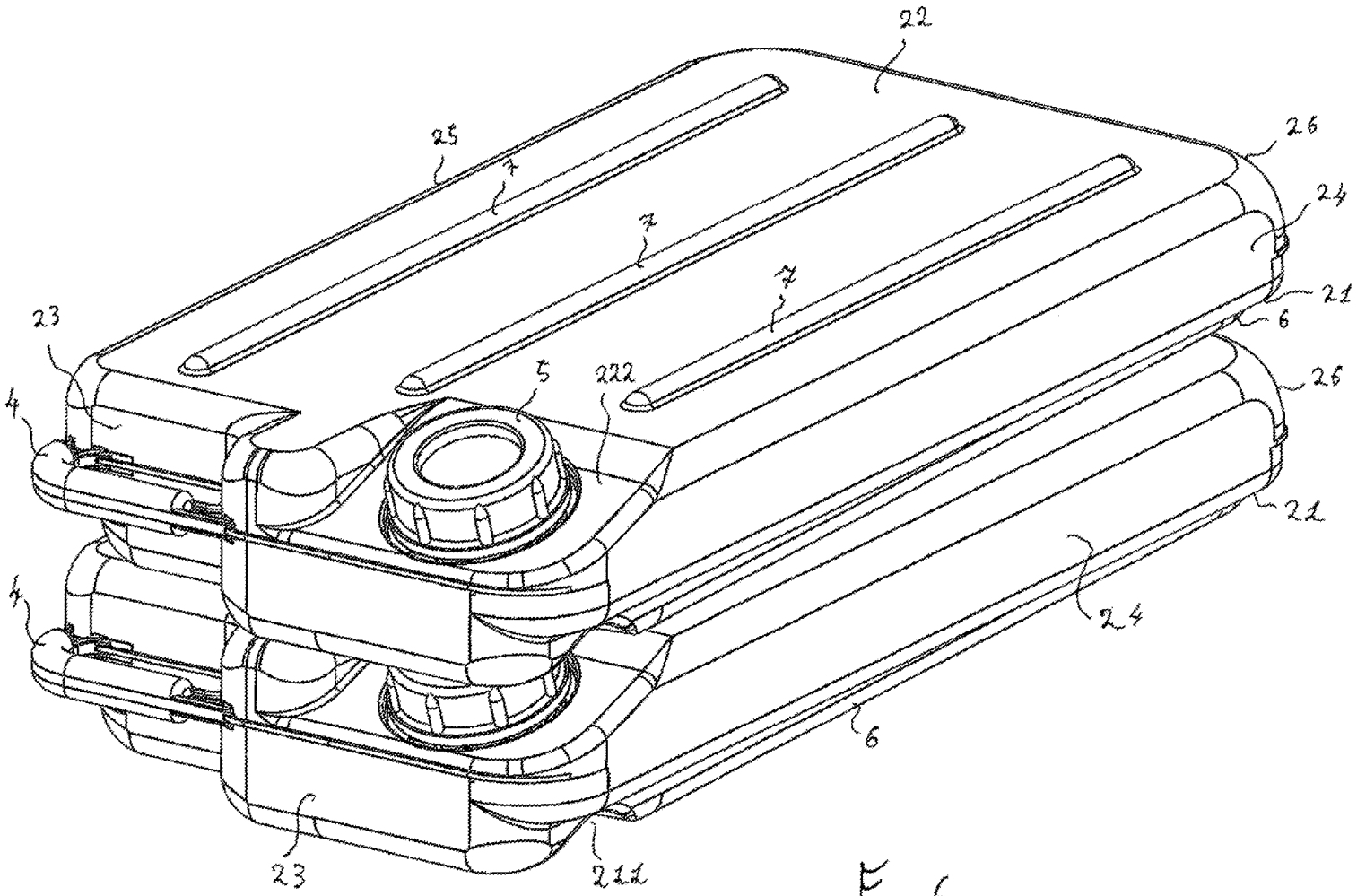
FIG. 6 shows an axonometric three-quarter view from above of two technical containers according to the present invention in which one container is stacked on top of the other.
Figure 17:
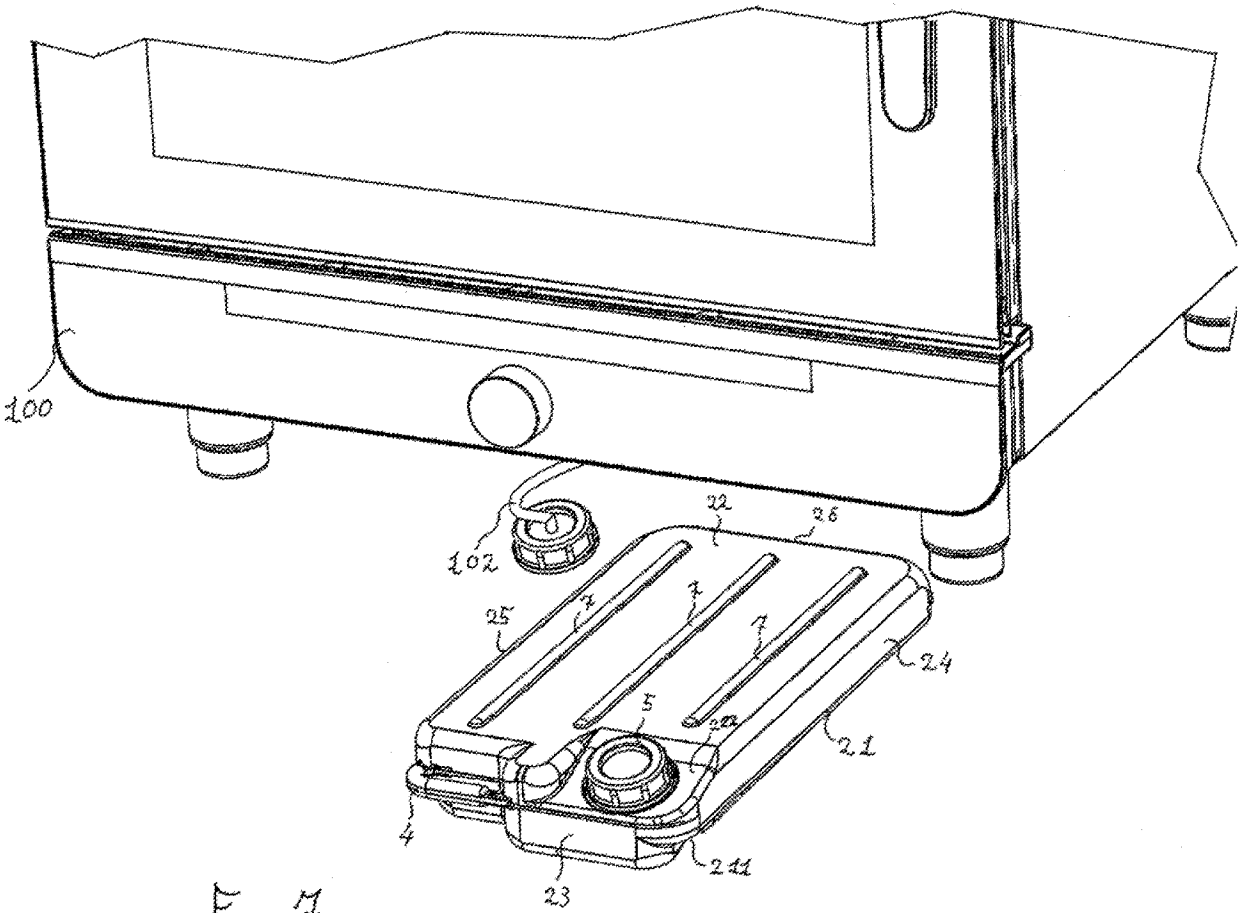

In order to allow that, when the technical container (1) is in an operating condition, that is to say, when it is in a horizontal position with the base wall (21) resting on a plane, the liquid which is contained inside the container body (2) is forced to flow towards the front portion of the container body (2), which coincides with the zone in which the threaded cylindrical mouth is positioned, it is provided that the base wall (21) of the container body (2), as shown in FIG. 5, is shaped in such a way as to be totally or partly inclined in the direction of the zone of the container body (2) in which the threaded cylindrical mouth is located. Furthermore, in order to compensate for the inclination of the base wall (21), the latter is provided with suitable protruding lower reinforcing ribs (6) which are conveniently made in such a way as to act both as a reinforcement and as a compensation for the inclination of the base wall (21) in such a way as to allow the technical container (1) to be kept horizontal with respect to the support surface. In more detail, the lower reinforcing ribs (6), which in the described embodiment are arranged longitudinally, are arranged parallel to each other, being positioned in such a way as to be able to cooperate with upper reinforcing ribs (7) with which the upper wall (22) of the container body (2) is provided to maintain the stacking stability of two or more technical containers (1) which are to be superimposed to one another, as is particularly shown in FIG. 6. The upper reinforcing ribs (7), as it is shown in FIGS. 1 to 6, are protruding, arranged longitudinally and parallel to each other, being preferably of a rounded shape.

Furthermore, in order to enable the stacking of one technical container (1) on top of the other, the base wall (21), in correspondence of the part opposite to that in which the threaded cylindrical mouth of the upper wall (22) is located, is provided with a suitable hollow (211) so as to allow to superimpose one technical container (1) on the other without the threaded cylindrical mouth and the threaded closing cap (5) of the technical container (1) placed below interfering with the base wall (21) of the container body (2) of the technical container (1) placed on top, wherein said hollow (211) with which the base wall (21) of the container body (2) is provided contributes to increasing stacking stability. Moreover, in order to allow the technical container (1) to be sliding, being hanging therefrom, on some suitable guides (101) placed below the professional oven (100), both the right side perimeter wall (24) and the left side perimeter wall (25) are shaped in such a way as to provide a longitudinal support step (8).

Thanks to the described embodiment, the technical container (1) of the present invention can be positioned, as shown in FIGS. 8 to 12, below the professional oven (100), it being able to act as a replaceable tank of the detergent liquid for feeding the washing device of the professional oven (100), on said technical container (1) it being possible to position the cap with the priming pipe (102) of the washing device of the professional oven (100) thus avoiding to occupy space outside the professional oven (100) as instead would occur if a container for chemical liquids of the known type were used.

Figure 8:
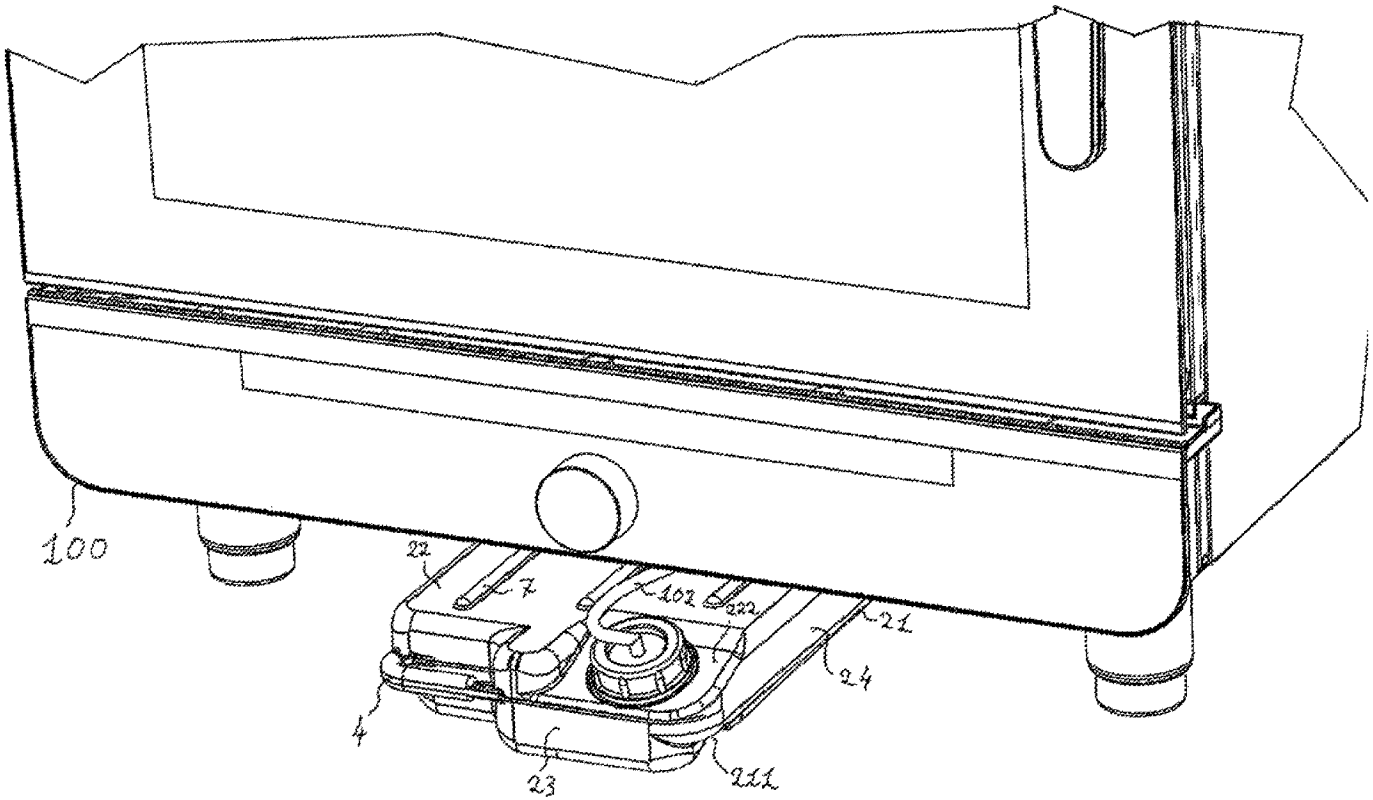
FIG. 8 shows a view of the technical container according to the present invention with replaceable capsule function partially positioned below the oven and with which the priming pipe of the washing device of the oven has been associated.
Figure 9:
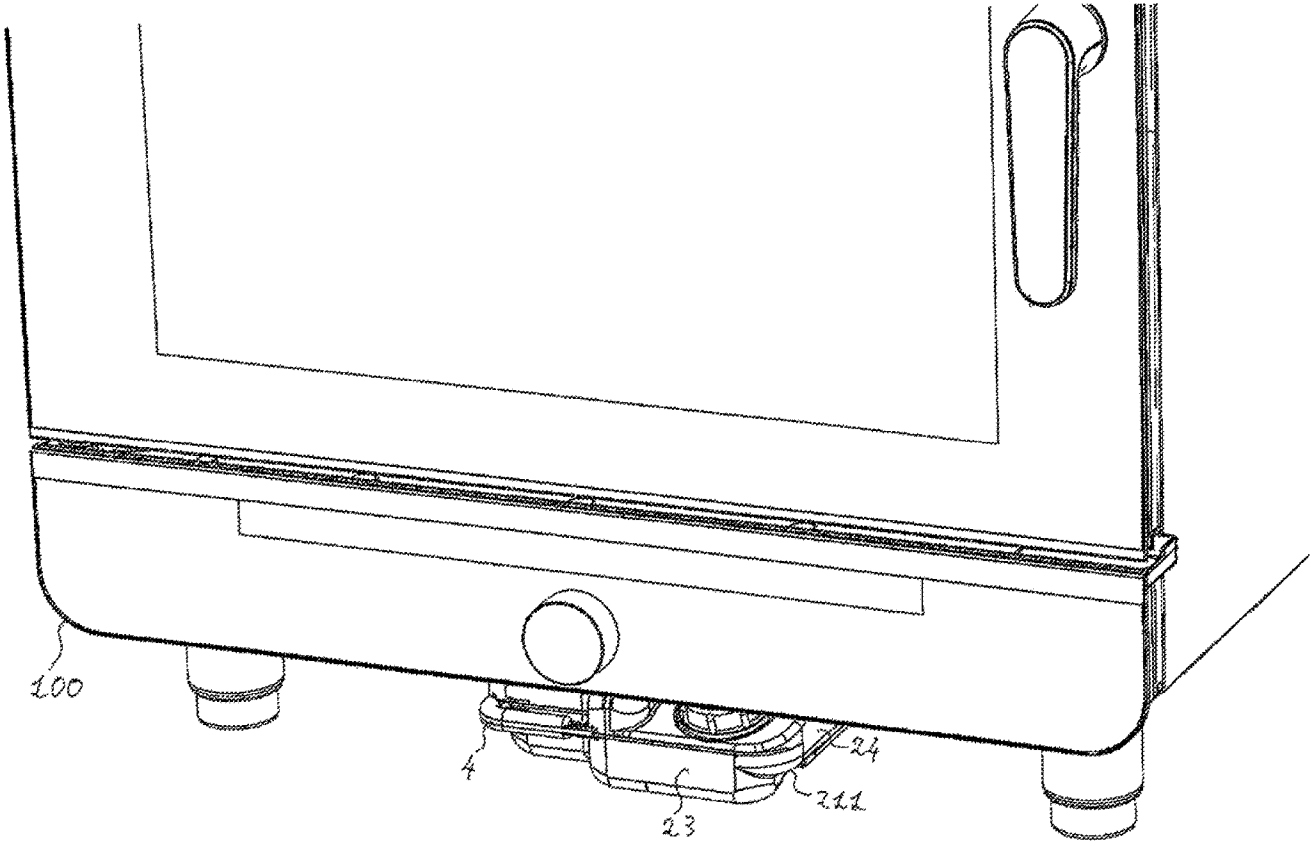
FIG. 9 shows a view of the technical container according to the present invention with replaceable capsule function completely positioned below the oven.

In detail the representations as in FIGS. 7 to 9 illustrate a possible positioning of the technical container (1) acting as a removable capsule which is positioned below the oven (100) showing in an essential way different positioning phases wherein in a first phase the technical container (1) as shown in FIG. 7 is positioned horizontally near the oven (100) in such a way as to be able to safely remove the threaded closing cap (5); in a second phase, as shown in FIG. 8, after the removal of the threaded closing cap (5), the cap with the priming tube (102) of the washing device of the oven (100) is associated with the threaded cylindrical mouth of the technical container (1), and wherein in a third phase, as shown in FIG. 9, the technical container (1) is positioned completely below the oven (100).

Figure 10:
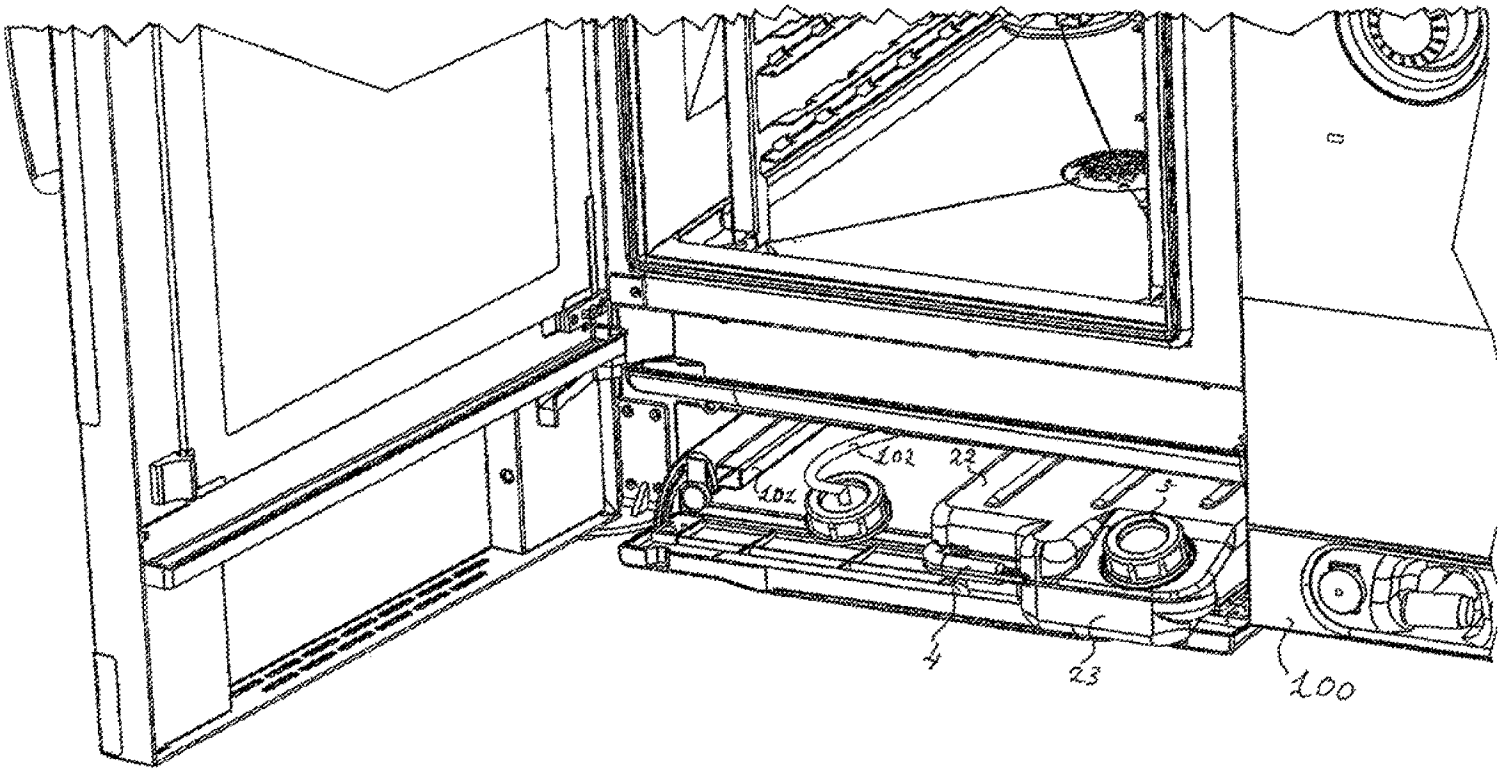
FIG. 10 shows a view of the technical container according to the present invention which is positioned, in an extractable way, within a suitable technical compartment with which the oven is provided.
Figure 11:
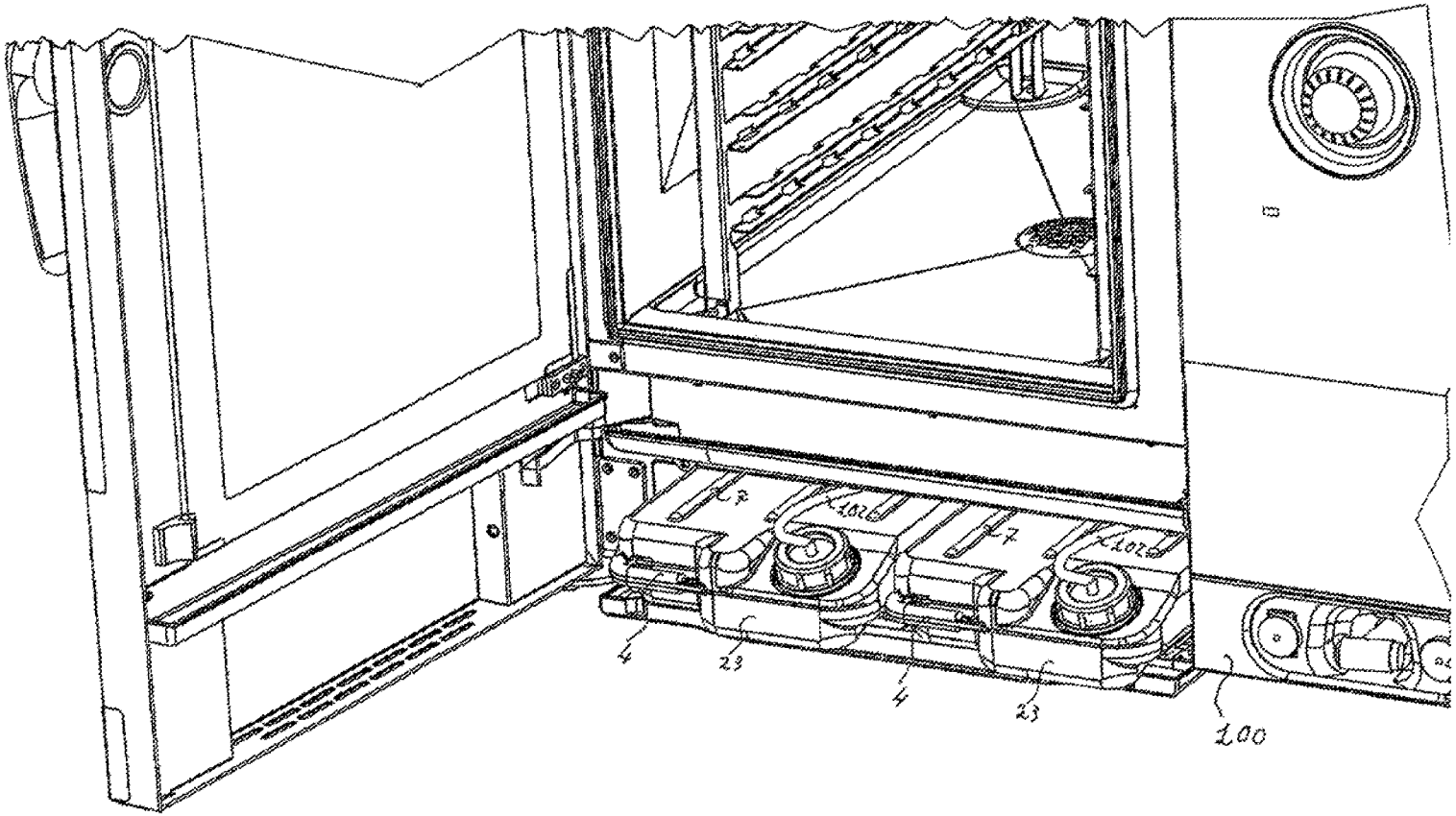
FIG. 11 shows a view of two technical containers according to the present invention which are positioned, adjacent to each other being extractable, within a suitable technical compartment with which the oven is provided.
Figure 12:
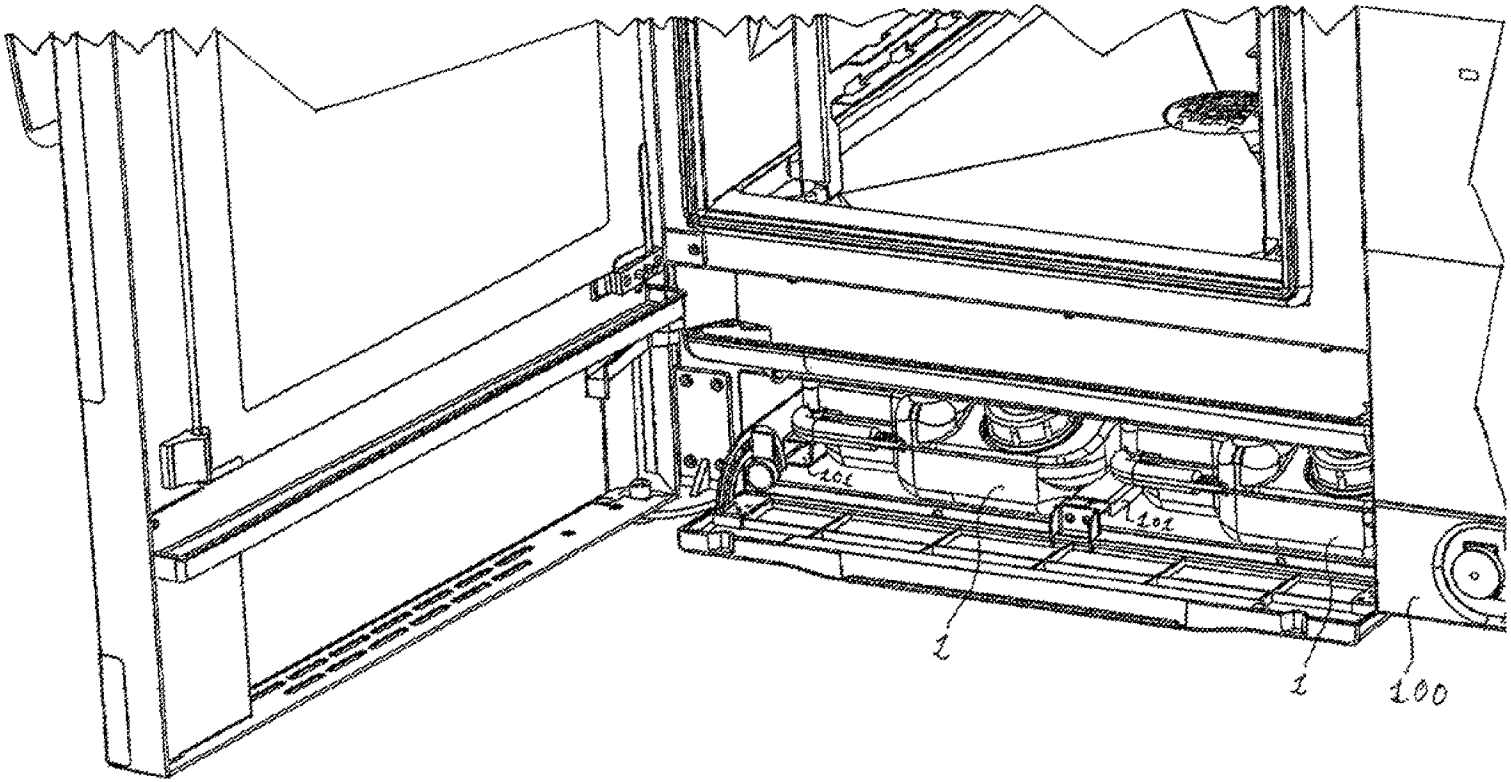
FIG. 12 shows a view of the two technical containers of FIG. 11 completely positioned inside the technical compartment of the oven.

In more detail, the representations as in FIGS. 10 to 12 show a possible positioning of the technical containers (1) acting as a removable capsule according to the present invention which are positioned in a suitable compartment with which the oven (100) is provided, illustrating said positioning of the technical containers (1) placed on suitable guides (101) with which the compartment below the cooking chamber of the oven (100) is provided, wherein FIG. 11 shows a possible positioning of two adjacent technical containers (1) feeding a washing system which requires the use of several cleaning liquids.

REFERENCE (1) technical container
(2) container body
(21) base wall
(211) hollow
(22) upper wall
(221) recessed seat
(222) recess
(23) front perimeter wall
(24) right side perimeter wall
(25) left side perimeter wall
(26) bottom perimeter wall
(3) containment chamber
(4) grip handle
(5) threaded closing cap
(6) lower reinforcing ribs
(7) upper reinforcing ribs
(8) longitudinal support step
(100) oven
(101) guides
(102) priming pipe

We claim:

1. A transportable container for chemical liquids, the transportable container comprising:

a container body having a base wall, an upper wall opposite to said base wall, and a plurality of perimeter walls extending between said base wall and said upper wall, said container body defining a containment chamber therein, a height of each of said plurality of perimeter walls between said base wall and said upper wall being less then a width or a length of either of said base wall and said upper wall;

a grip handle extending outwardly for a distance from one of said plurality of perimeter walls;

a threaded cylindrical mouth positioned in a recess in said upper wall and extending outwardly and upwardly therefrom, said recess extending from said upper wall downwardly toward said one of said plurality of perimeter walls, an outer periphery of said threaded cylindrical mouth positioned inwardly of a plane extending across an outer face of said one of said plurality of perimeter walls, said base wall being inclined downwardly from another perimeter wall opposite said one of said perimeter walls toward said one of said perimeter walls such that a fluid in said container body flows towards said threaded cylindrical mouth when said base wall is on a horizontal surface; and a closing cap removably affixed to said threaded cylindrical mouth.

2. The transportable container of claim 1, said threaded cylindrical mouth positioned adjacent to said one of said plurality of perimeter walls.

3. The transportable container of claim 1, said base wall having a plurality of reinforcing ribs extending downwardly therefrom, said plurality of reinforcing ribs having bottoms that are coplanar with each other.

4. The transportable container of claim 3, said upper wall having a plurality of reinforcing ribs extending upwardly therefrom and arranged longitudinally parallel to said plurality of reinforcing ribs of said base wall.

5. The transportable container of claim 1, said upper wall having a plurality of reinforcing ribs that extend upwardly therefrom.

6. The transportable container of claim 5, said plurality of reinforcing ribs being parallel to each other.

7. The transportable container of claim 1, said base wall having a hollow formed therein corresponding in location to a location of said threaded cylindrical mouth at said upper wall of said container.

8. The transportable container of claim 1, a right side wall and a left side wall of said plurality of perimeter walls defining a longitudinal support step.

9. The transportable container of claim 1, said grip handle extending outwardly of an inset portion of said one of said plurality of perimeter walls such that an end of said grip handle opposite said inset portion is within the plane extending across the face of said one of said plurality of perimeter walls and is within a width of said container, said container being formed entirely of a plastic material.

* * * * *